US009834999B2

(12) United States Patent
Fraley et al.

(10) Patent No.: US 9,834,999 B2
(45) Date of Patent: Dec. 5, 2017

(54) POST HOLE DIGGER

(75) Inventors: J. Phillip Fraley, Winfield, AL (US); John W. Davis, III, Winfield, AL (US)

(73) Assignee: King Kutter, Inc., Winfield, AL (US)

( * ) Notice: Subject to any disclaimer, the term of this patent is extended or adjusted under 35 U.S.C. 154(b) by 528 days.

(21) Appl. No.: 13/548,836

(22) Filed: Jul. 13, 2012

(65) Prior Publication Data

US 2013/0014997 A1 Jan. 17, 2013

Related U.S. Application Data

(60) Provisional application No. 61/507,146, filed on Jul. 13, 2011.

(51) Int. Cl.

| | |
|---|---|
| ***E21B 19/087*** | (2006.01) |
| ***E02D 5/80*** | (2006.01) |
| ***E21B 7/02*** | (2006.01) |

(52) U.S. Cl.

CPC ..... *E21B 19/087* (2013.01); *E02D 5/801* (2013.01); *E21B 7/028* (2013.01)

(58) Field of Classification Search

CPC ..... E02F 3/06; A01L 371/08; E21B 19/087; E21B 7/028; E21B 7/027; E21B 7/005; A01B 71/08

USPC ..... 175/122, 162, 202, 203, 323, 325.1; 173/25, 26, 185; 74/612, 324; 464/178

See application file for complete search history.

(56) References Cited

U.S. PATENT DOCUMENTS

| | | | | |
|---|---|---|---|---|
| 1,176,992 A | * | 3/1916 | Sholl | E21B 10/26 175/381 |
| 1,951,192 A | | 3/1934 | Hantjopoulos | |
| 2,273,203 A | | 2/1942 | Keene et al. | |
| 2,320,610 A | | 6/1943 | Kandle | |
| 2,401,250 A | | 5/1946 | Kandle | |
| 2,772,549 A | * | 12/1956 | Harrington | 464/178 |
| 2,838,285 A | | 6/1958 | Gredell | |
| 2,912,228 A | | 11/1959 | Kandle | |
| 3,093,199 A | | 6/1963 | Premo | |
| 3,235,018 A | | 2/1966 | Troeppl | |

(Continued)

FOREIGN PATENT DOCUMENTS

WO 2010/025500 A1 3/2010

OTHER PUBLICATIONS

International Search Report and Written Opinion dated Feb. 1, 2012 in International Application No. PCT/US2011/050189, 14 pages.

*Primary Examiner* — Carib A Oquendo

(74) *Attorney, Agent, or Firm* — Angela Holt; Bradley Arant Boult Cummings LLP

(57) ABSTRACT

A post hole digger couples to the power take-off (PTO) shaft of a tractor and uses rotation from the PTO shaft to rotate an auger. A top support arm rotatably coupled to the top pin of the tractor's three point hitch supports the gearbox that translates rotation to the auger. A support frame extends upwardly from the right and left lift arms of the three point hitch and inwardly to support the top support arm from beneath. The support frame is shaped generally as an inverted "U," with space created between the right and left lift arms to prevent interference with the rotating shaft that translates rotation from the PTO shaft to the gearbox. A shield coupled to the gearbox covers the moving parts of the joint between the rotating shaft and the gearbox and protects users during use of the auger.

14 Claims, 10 Drawing Sheets

(56) References Cited

U.S. PATENT DOCUMENTS

| | | | | |
|---|---|---|---|---|
| 3,375,890 | A | 4/1968 | Petersen | |
| 3,710,677 | A | 1/1973 | Michasiw | |
| 3,902,562 | A | 9/1975 | Pessier et al. | |
| 3,998,283 | A | 12/1976 | Chitwood et al. | |
| D267,405 | S | 12/1982 | Wilson | |
| 4,492,493 | A * | 1/1985 | Webb | F16L 1/201 405/172 |
| 4,601,348 | A * | 7/1986 | Cox | 173/25 |
| 4,819,744 | A | 4/1989 | Caswell | |
| 5,820,319 | A | 10/1998 | Hull et al. | |
| 6,128,867 | A * | 10/2000 | MacKarvich | E02D 5/801 52/155 |
| 6,216,803 | B1 | 4/2001 | Deken | |
| 6,328,273 | B1 * | 12/2001 | Kemikem | E04H 12/2223 248/121 |
| 6,655,476 | B2 | 12/2003 | Groce, Jr. et al. | |
| 6,725,950 | B2 * | 4/2004 | Palm | 175/162 |
| 7,210,543 | B1 * | 5/2007 | Sumner | 175/323 |
| 7,357,399 | B1 * | 4/2008 | Klotz | 280/79.11 |
| 2009/0321134 | A1 * | 12/2009 | Matthews et al. | 175/57 |
| 2012/0125693 | A1 * | 5/2012 | Banjo et al. | 175/170 |

* cited by examiner

POST HOLE DIGGER

CROSS-REFERENCE TO RELATED APPLICATIONS

This application claims the benefit of U.S. Provisional Application No. 61/507,146 titled "Post Hole Digger," filed on Jul. 13, 2011, the entire contents of which are incorporated herein by reference.

BACKGROUND AND SUMMARY OF THE INVENTION

A post hole digger attaches to the standard three point hitch of the tractor and is powered by the tractor's power take-off (PTO). The digger comprises an auger without protrusions or other extending parts above the fighting of the auger, to reduce the possibility of a user becoming ensnared during use of the digger. A shield covering rotating parts of the PTO shaft is rigidly affixed to the support arm that supports the auger.

In one embodiment, the shield is rigidly affixed to the gearbox that translates rotation from the PTO shaft to the auger. The shield therefore moves with the gearbox as the auger is adjusted, maintaining a uniform cover over the rotating parts of the PTO shaft and protecting users. In another embodiment, the shield is rotatably affixed to the gearbox and is sized to provide appropriate coverage regardless of the position of the auger in use.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
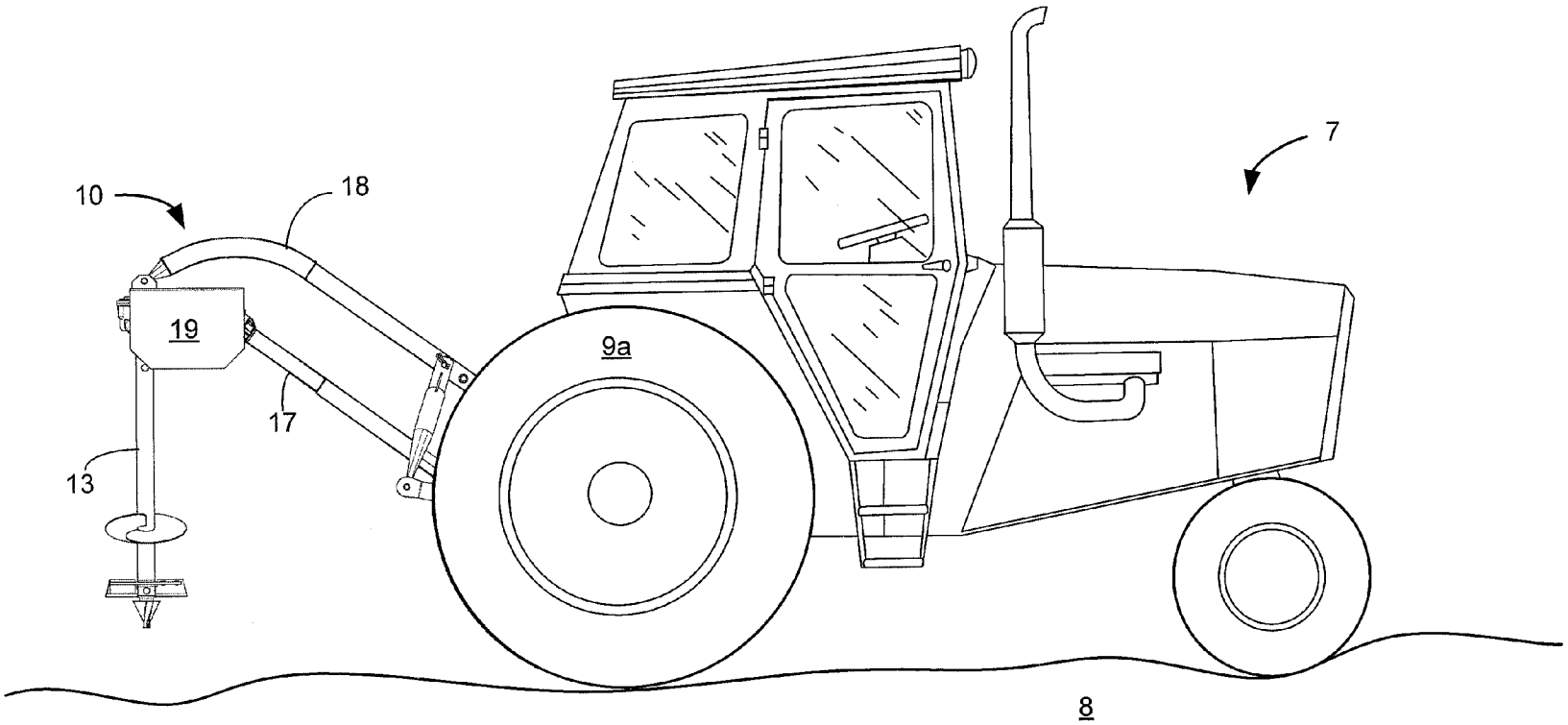
FIG. 1 is a side plan view of a post hole digger according to an embodiment of the present disclosure coupled to a tractor.

FIG. 1 is a side plan view of a post hole digger 10 according to an exemplary embodiment of the present disclosure. The digger 10 is shown installed on a tractor 7 and is used to dig generally-cylindrical holes (not shown) in the ground 8, for example, holes for fence posts. The digger 10 is disposed at the rear of the tractor 7 between the rear wheels 9*a* and 9*b* (FIG. 2).

The digger 10 comprises an auger 13 for drilling into the ground 8. The auger 13 is supported by a top support arm 18 that extends from the tractor 7 as further discussed herein. A rotating shaft 17 extends from a PTO shaft (not shown) of the tractor 7 and translates rotation from the PTO shaft to a gearbox 12, and ultimately to the auger 13. A shield 19 covers moving parts (not shown) that can pose a safety hazard to users (not shown) of the digger 10.

Figure 2:
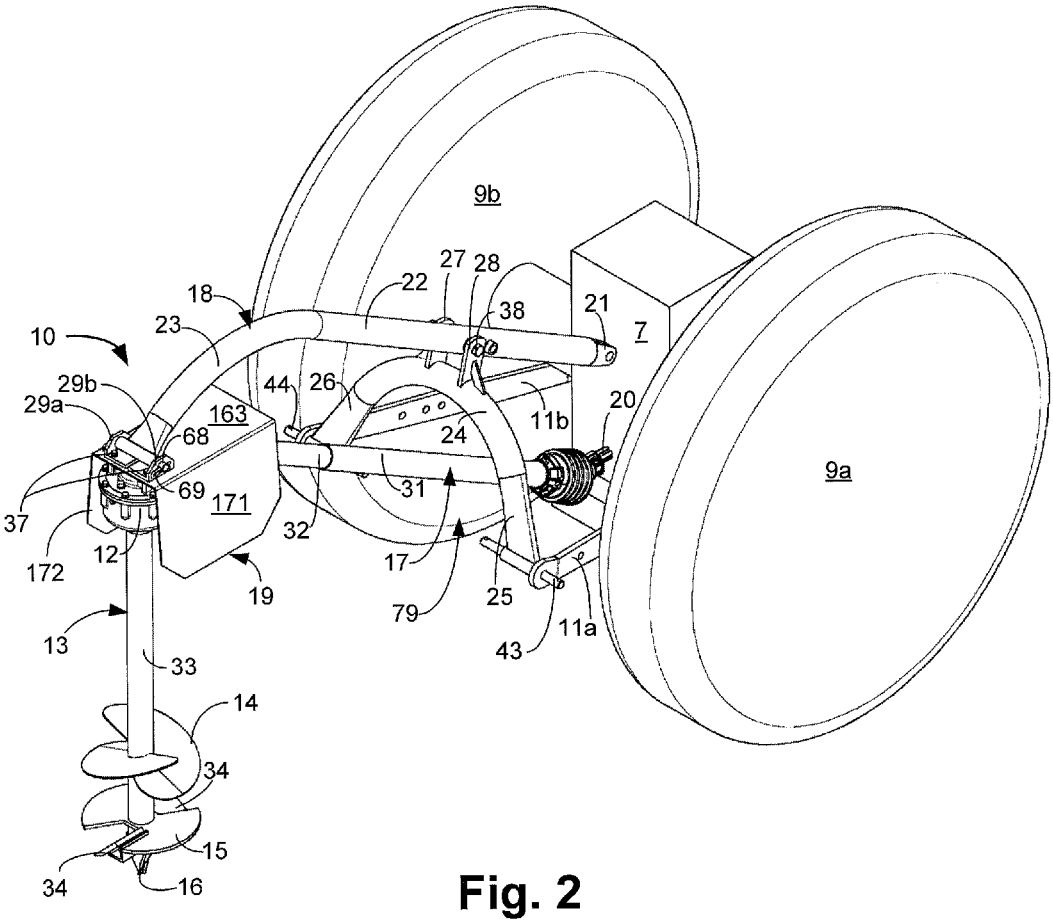
FIG. 2 is a rear perspective view of the post hole digger of FIG. 1.

FIG. 2 is a rear perspective view of the digger 10 installed on the tractor 7 between the wheels 9*a* and 9*b* of the tractor 7. The digger 10 connects to the tractor's standard three point hitch that is known in the art. The term "three point hitch" refers to the three mounting points of a tractor hitch that extend rearwardly from the rear of the tractor 7. The three point hitch comprises a topmost point 21, a right lift arm 11*a* and a left lift arm 11*b*. The topmost point 21 of the three point hitch connects to the top support arm 18. Specifically, the top support arm 18 comprises a generally straight segment 22 and a generally curved segment 23. The straight segment 22 is releasably affixed to the topmost point 21 of the three point hitch. The right and left lift arms 11*a* and 11*b* releasably affix to a support frame 24 that supports the support arm 18.

In this embodiment, the support frame 24 comprises a curved frame generally shaped as an inverted "U." A lower right end 25 of the support frame 24 rotatably connects to the right lift arm 11*a* via a pin 43 that passes through an opening (not shown) of the right lift arm 11*a*. A lower left end 26 of the support frame 24 rotatably connects to the left lift arm 11*b* via a pin 44 that passes through an opening of the left lift arm 11*b*. The support frame 24 is thus rotatable with respect to the lift arms 11*a* and 11*b*.

The inverted "U" shape of the support frame 24 allows the frame 24 to support the support arm 18 without interfering with the operation of the rotating shaft 17. In other words, the rotating shaft 17 is free to rotate, and otherwise move within, the open space 79 within the inverted "U" shape of the support frame 24. By way of example only, if the support frame 24 extended directly between the right and left lift arms 11*a* and 11*b* and then upwardly, instead of arching upward as illustrated, the support frame 24 might interfere with the operation of the rotating shaft 17.

At its upper end, the support frame 24 comprises a pair of brackets 27 and 28 that rotatably affix to the straight segment 22 of the support arm 18. In this regard, openings (not shown) in the straight segment 22 receive a fastener 38 rotatably connecting the brackets 27 and 28 to the straight segment 22.

The support arm 18 extends upwardly and rearwardly from the tractor 7. The straight segment 22 and the curved segment 23 of the support arm 18 are comprised of hollow metal tubing in the illustrated embodiment. Although the metal tubing comprising the curved segment 23 and the straight segment 22 is shown as round tubing in FIG. 2, tubing with a square or rectangular cross section is employed in other embodiments. The curved segment 23 of the support arm curves downwardly from a rearward end of the straight segment 22 to the shield 19.

The curved segment 23 is rotatably affixed to the shield 19. In this regard, top shield brackets 29*a* and 29*b* are rigidly affixed to the shield 19. The top shield brackets 29*a* and 29*b* comprise openings (not shown) which receive a pin 68 which extends through the bracket 29*b*, through an opening (not shown) in the curved segment 23, and through the bracket 29*b*. The pin 28 is secured with a pair of hairpin retainers 69 (only one of which is shown in FIG. 2). The top shield brackets 29*a* and 29*b* are rigidly affixed to the shield 19 by welding in this embodiment, though other means of rigidly affixing the top shield brackets 29*a* and 29*b* to the shield 19 may be utilized in other embodiments. Further, other means of rotatably connecting the shield 19 to the support arm 18 may be utilized in other embodiments.

The shield 19 is formed from generally thin rigid material and is metallic in the illustrated embodiment. The shield 19 is formed as a generally inverted "U" shape when viewed from the rear of the digger 10, and is comprised of a top segment 163, a downwardly-extending right segment 171, and a downwardly-extending left segment 172. In the illustrated embodiment, the top segment 163, right segment 171, and left segment 172 of the shield 19 are formed from bending a unitary flat piece of metal.

The shield 19 is rigidly affixed to the gearbox 12, via fasteners 37 in this embodiment, though other means of rigidly affixing the shield to the gearbox may be utilized in other embodiments. The shield 19 is not detachable from the digger in this embodiment without making the digger non-functional, to provide safety for the user.

The rotating shaft 17 is releasably coupled to a PTO shaft 20 of the tractor 7. As known by persons of skill in the art, a power-take off shaft is a splined shaft that is rotatable by the user (not shown) upon actuation of the tractor controls (not shown). Rotation of the PTO shaft 20 typically powers farming implements such as the digger 10. The rotating shaft 17 extends from the PTO shaft 20 to the gearbox 12, as further discussed herein. The rotating shaft 17 is comprised of hollow tubing in the illustrated embodiment.

The shaft 17 telescopes (i.e., becomes longer or shorter) as required during the operation of the digger 10. In this regard, a frontward segment 31 of the rotating shaft 17 is extendably coupled to a rearward segment 32 of the rotating shaft. An outer diameter of the rearward segment 32 is larger than an inner diameter of the frontward segment 31 such that the rearward segment 32 is received by and extendably slides within the frontward segment 31.

The gearbox 12 receives rotation from the rotating shaft 17 and translates the received rotation to the auger 13. In this embodiment, the auger 13 comprises a rotatable auger shaft 33, fighting blades 14 and a cutting head 15. The cutting head 15 is disposed at the lowermost end of the shaft 33, and comprises a pilot bit 16 and a pair of cutting blades 34. The fighting blades 14 are disposed above the cutting head 15.

The shaft 33 is formed from generally cylindrical hollow tubing in the illustrated embodiment. The outer surface of the shaft 33 is generally smooth above the fighting blades 14, and has no protrusions or other irregularities above the fighting blades 14 that may ensnare or entangle a user during use.

Figure 3:
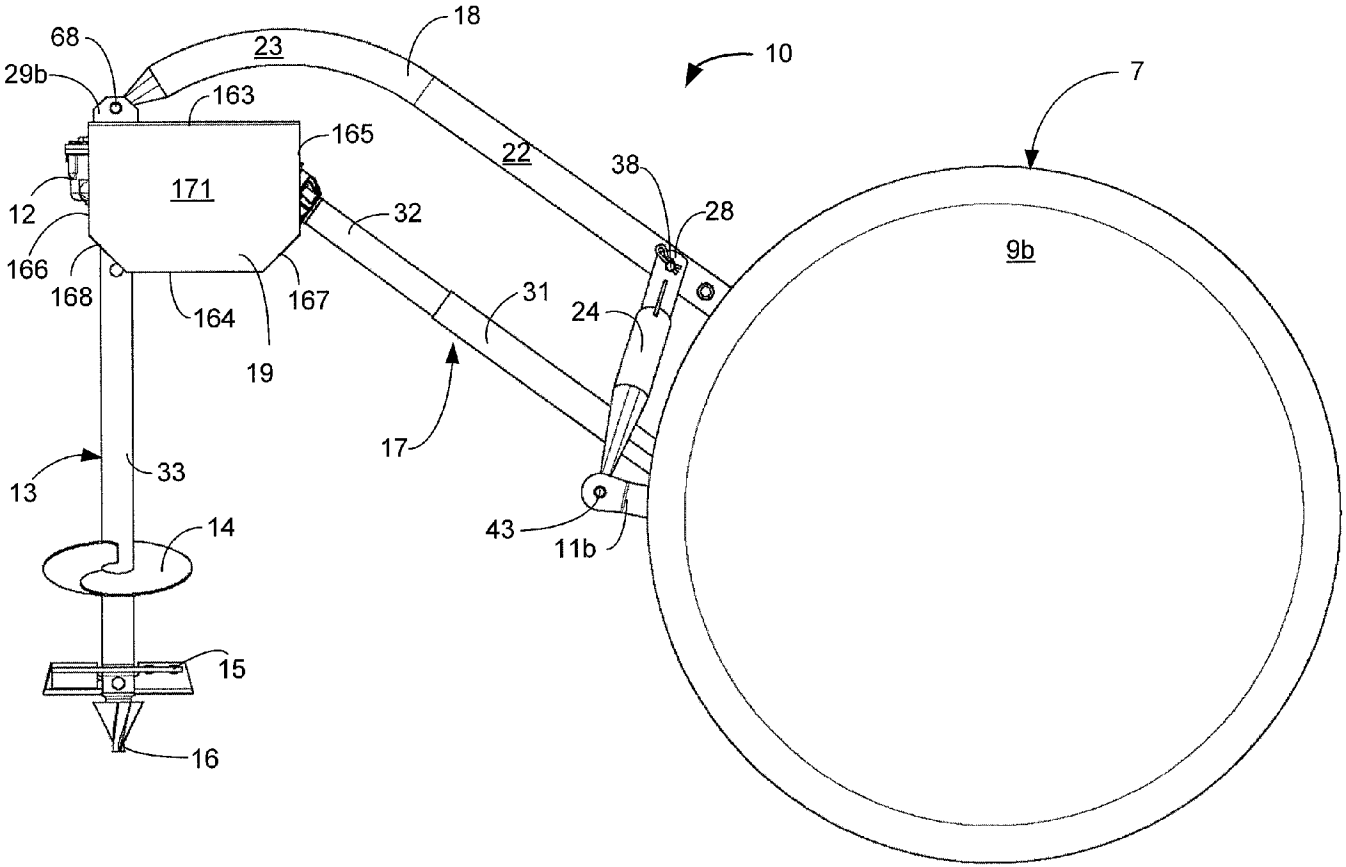
FIG. 3 is an enlarged side plan view of the post hole digger of FIG. 1.

FIG. 3 is an enlarged side plan view of the digger 10 of FIG. 1. The right segment 171 of the shield 19 extends downwardly from the top segment 163. The right segment 171 comprises a front edge 165 that extends downwardly from the top segment 163, a rear edge 166 that extends downwardly from the top segment 163, and a bottom edge 164. Chamfers 167 and 168 at the intersections of the front edge 165 with the bottom edge 164 and the rear edge 166 with the bottom edge 164 eliminate sharp corners from the shield 19. Although not illustrated in FIG. 3, the left segment 172 (FIG. 2) is substantially similar to, and a mirror image of, the right segment 171.

Figure 4:
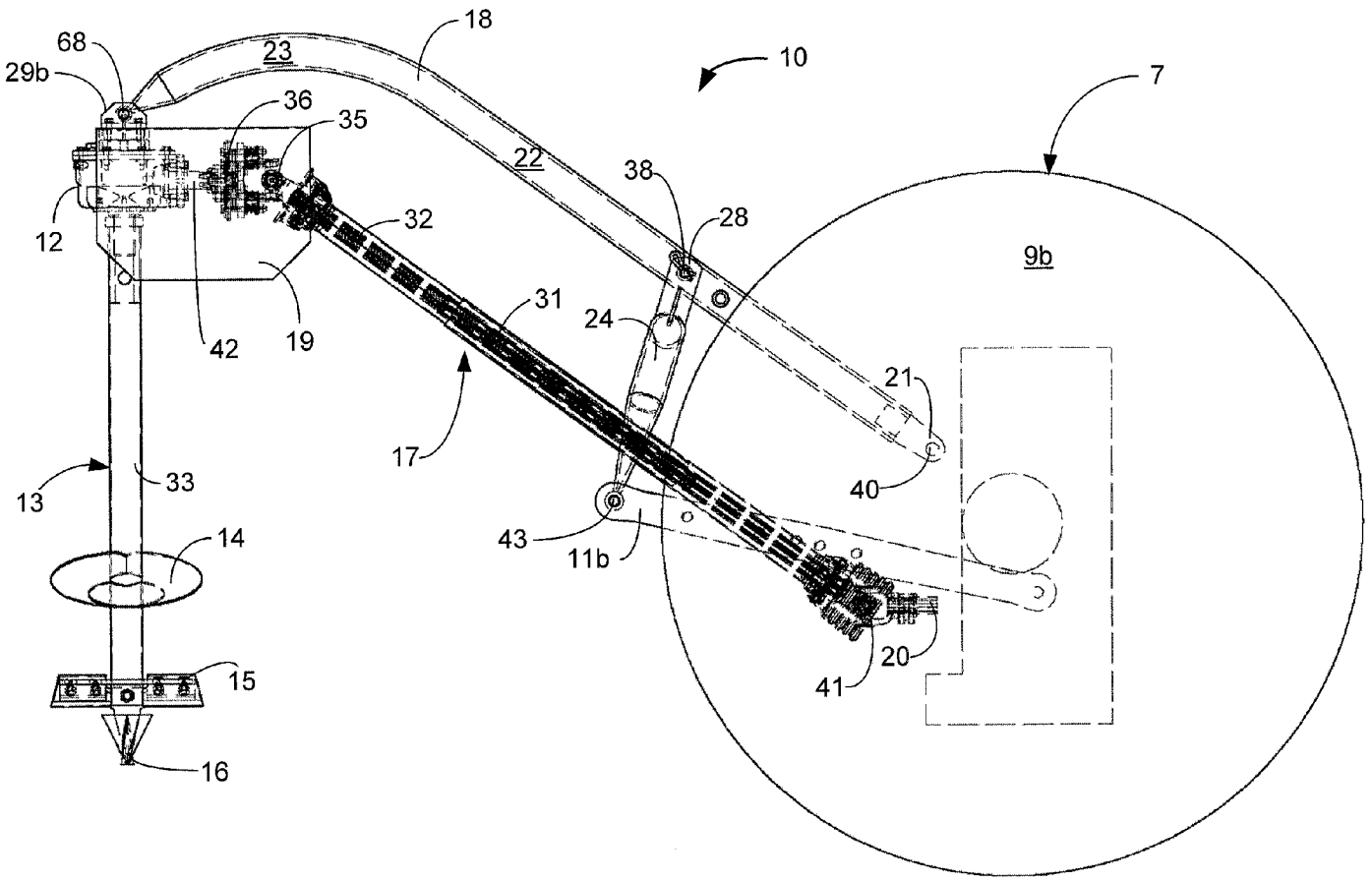
FIG. 4 is a side plan view of the post hole digger of FIG. 3, with hidden lines included to show detail hidden by the shield.

FIG. 4 is a side plan view of the digger 10 of FIG. 3, with hidden lines included to show detail hidden by the shield 19 and tractor 7. As discussed above, the rotating shaft 17 receives rotation from the PTO shaft 20 and translates that rotation to the gearbox 12. The rotating shaft 17 extends upwardly and at an angle from the PTO shaft 20 and terminates at a cross and bearing joint 35. The cross and bearing joint 35 translates rotation from the rotating shaft 17 to a slip clutch 36. The slip clutch 36 is a friction clutch that will slip when the torque from the rotating shaft 17 becomes too great, for example, if the auger 13 stops turning due to an obstruction. The slip clutch 36 minimizes the possibility of damage to the digger 10 in this event. Prior art diggers typically use shear bolts (not shown) that are known in the art to protect against such damage. A shear bolt is an intentionally-weakened part that will break if the auger 13 stops turning or becomes entangled. A disadvantage of shear bolts is that they must be replaced after they break. The slip clutch 36 is a more durable solution.

The slip clutch 36 is rigidly affixed to a gearbox shaft 42 that extends frontwardly from the gearbox 12. The slip clutch 36 and the gearbox shaft 42 both rotate upon receipt of rotation from the rotating shaft 17.

The shield 19 covers the joint 35 and clutch 36 and gearbox shaft 42 to minimize the possibility of a user becoming entangled in the moving parts in the vicinity of the joint 35. Because the shield 19 is rigidly affixed to the gearbox 12, the shield covers the joint 35 regardless of the position of the digger 10 (i.e., regardless of whether the digger is lowered or raised during digging of a hole).

The top support arm 18 rotates in a generally vertical plane with respect to the tractor 7 around point 40. The top support arm 18 is rotatably affixed to the shield 19 via the top shield bracket 29*b* and pin 68. The support frame 24 is rotatable around the pin 43 and also around the fastener 38 (at the bracket 28).

Figure 5:
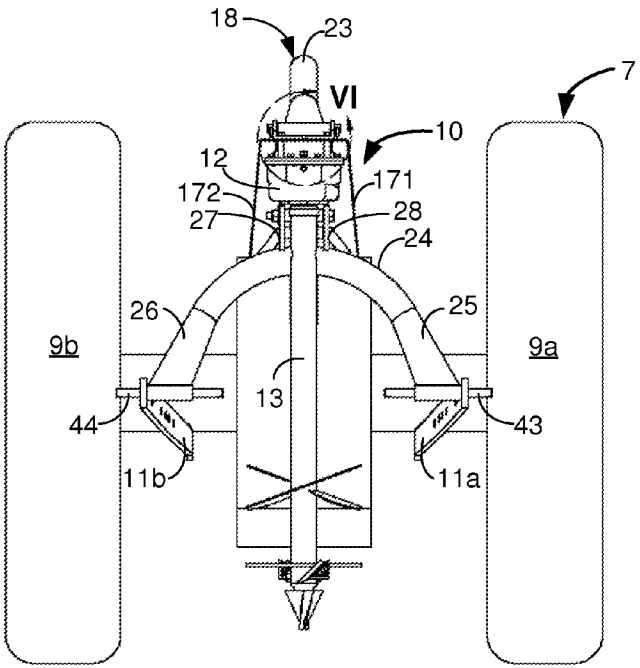
FIG. 5 is a rear plan view of the post hole digger of FIG. 1.

FIG. 5 is a rear plan view of the digger 10 of FIG. 1. As was discussed above, the lower right end 25 of the support frame 24 rotatably connects to the right lift arm 11*a* via the pin 43 that passes through the lower right end 25 and through the right lift arm 11*a*. The lower left end 26 of the support frame 24 rotatably connects to the left lift arm 11*b* via the pin 44 that passes through an opening of the left lift arm 11*b*. The support frame 24 is thus rotatable with respect to the lift arms 11*a* and 11*b* at pins 43 and 44.

The support frame 24 is in the general shape of an inverted "U," and this shape allows the frame 24 to support the support arm 18, using the right and left lift arms 11*a* and 11*b*, without interfering with the operation of the rotating shaft 17.

The support frame 24 extends upwardly and inwardly from the right lift arm 11*a* and extends upwardly and inwardly from the left lift arm 11*b*. The support arm 18 is located generally centrally with respect to the support frame 24, as illustrated.

Figure 6:
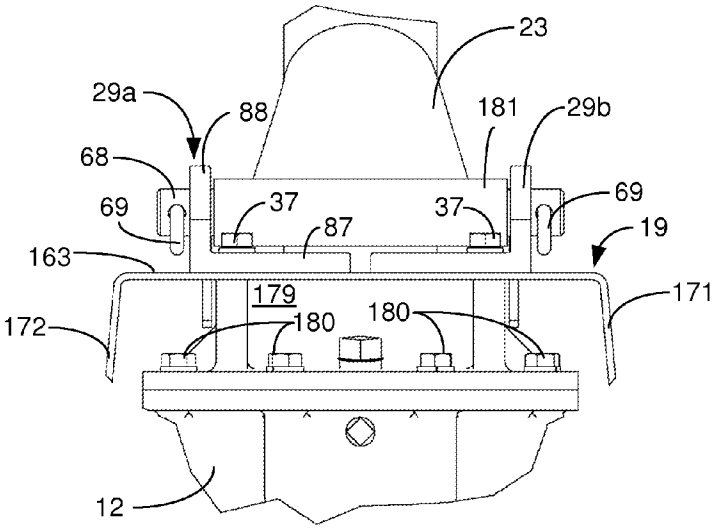
FIG. 6 is an enlarged detail view of the digger of FIG. 5, taken along detail line A of FIG. 5.

FIG. 6 is an enlarged detail view of the digger 10 of FIG. 5, taken along detail line "A" of FIG. 5. The shield bracket 29*a* comprises an upwardly-extending portion 88 that comprises an opening (not shown) for receiving the pin 68. The shield bracket 29*a* further comprises a bottom portion 87 that is rigidly affixed to the top segment 163 of the shield 19, by welding in the illustrated embodiment. The shield bracket 29*b* is substantially similar to, and a mirror image of, the bracket 29*a*. The curved segment 23 at its rearward end comprises a sleeve bracket 181 that receives the pin 68. The pin thus passes through the shield bracket 29*a*, the sleeve bracket 181, and the shield bracket 29*b*, in order to rotatably couple the curved portion 23 of the top support arm 18 (FIG. 5) to the shield 19. The hairpin retainers 69 retain the pin 68 within the brackets 29*a*, 181, and 29*b*.

The gearbox 12 comprises a top gearbox cover 179 that is rigidly affixed to the gearbox 12 via a plurality of fasteners 180. The gearbox cover 179 is further rigidly affixed to the shield 19 via a plurality of fasteners 37. In this manner, the shield 19 is rigidly affixed to the gearbox 12, and cannot be removed from the gearbox 12 without rendering the digger 10 (FIG. 5) inoperable.

Figure 7:
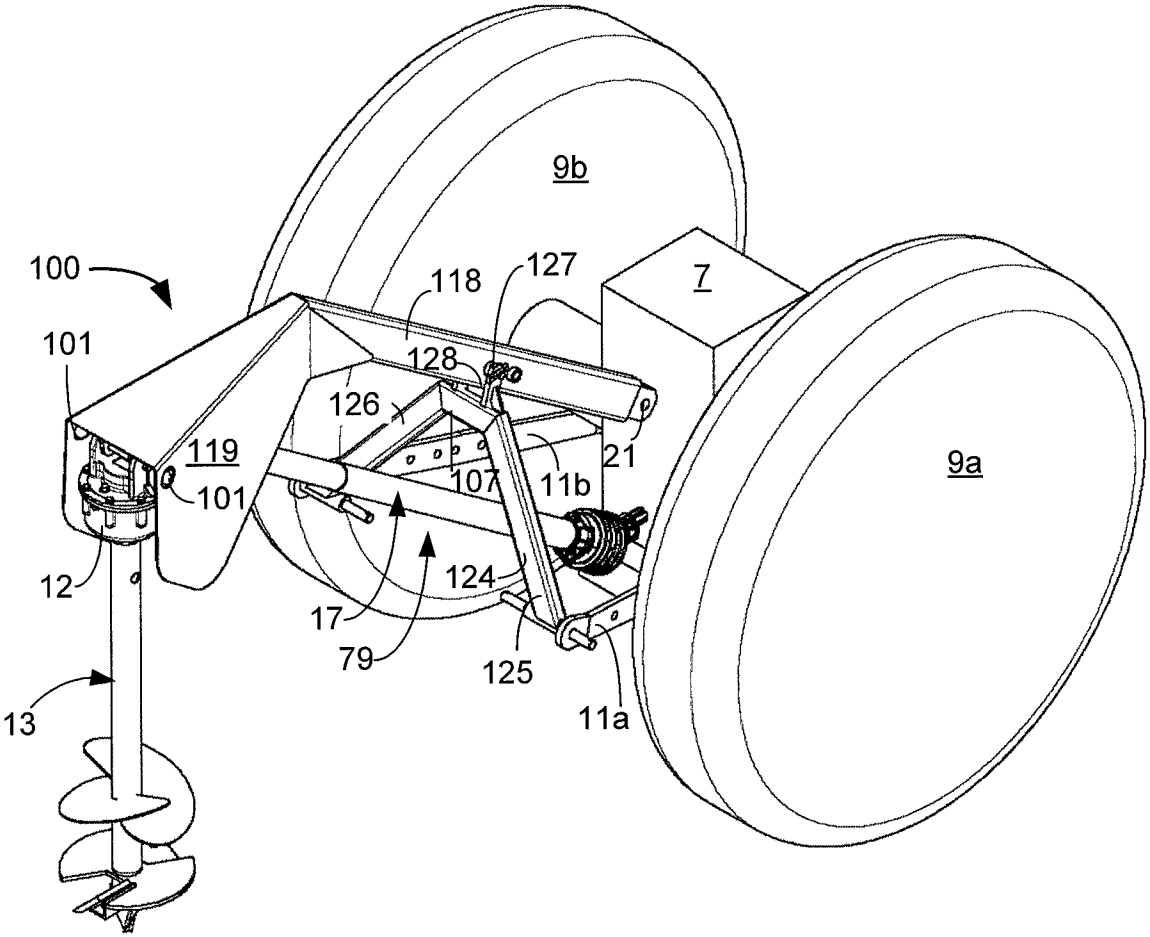
FIG. 7 is a rear perspective view of a post hole digger according to an embodiment of the present disclosure.

FIG. 7 is a rear perspective view of a post hole digger 100 according to an alternative embodiment of the present disclosure. The post hole digger 100 comprises the substantially similar rotating shaft 17, gearbox 12, and auger 13 as the post hole digger 10 of FIG. 2. In this embodiment, a shield 119 covers the rotating parts (not shown) of the digger 100. However, the shield 119 is not rigidly affixed to the gearbox 12 in this embodiment. Rather, the shield 119 is rigidly affixed to the top support arm 118, and the gearbox 12 is rotatably affixed to the top support arm 118, such that the gearbox 12 rotates with respect to the top support arm 118 along an axis (not shown) passing through openings 101 of the shield, as further discussed below.

The top support arm 118 extends from and is rotatably coupled to the topmost point 21 of the three point hitch of the tractor 7 and supports the gearbox 12 and auger 13. A support frame 124 extends between and is rotatably affixed to the right lift arm 11*a* and left lift arm 11*b*. The support frame 124 extends up to and rotatably couples with the top support arm 118. In this manner the support frame 124 rotatably supports the top support arm 118.

The support frame 124 is generally in the shape of an inverted "U" with a right segment 125 extending upwardly and at an angle from the right lift arm 11*a*, a left segment 126 extending upwardly and at an angle from the left lift arm 11*b*, and a connecting segment 107 extending between the right segment 125 and the left segment 126. The connecting segment 107 is generally straight and generally horizontal in the illustrated embodiment. A pair of brackets 128 (only one of which is shown in FIG. 7) extends upwardly from the connecting segment 107 and rotatably affixes the connecting segment 107 to the top support arm 118 via a pin 127 that extends through the top support arm 118.

The inverted "U" shape of the support frame 124 allows the frame 124 to support the support arm 118 without interfering with the operation of the rotating shaft 17. In other words, the rotating shaft 17 is free to rotate, and otherwise move within, the open space 79 within the inverted "U" shape of the support frame 124. By way of example only, if the support frame 124 extended directly between the right and left lift arms 11*a* and 11*b* and then upwardly, instead of arching upward as illustrated, the support frame 124 might interfere with the operation of the rotating shaft 17.

Figure 8:
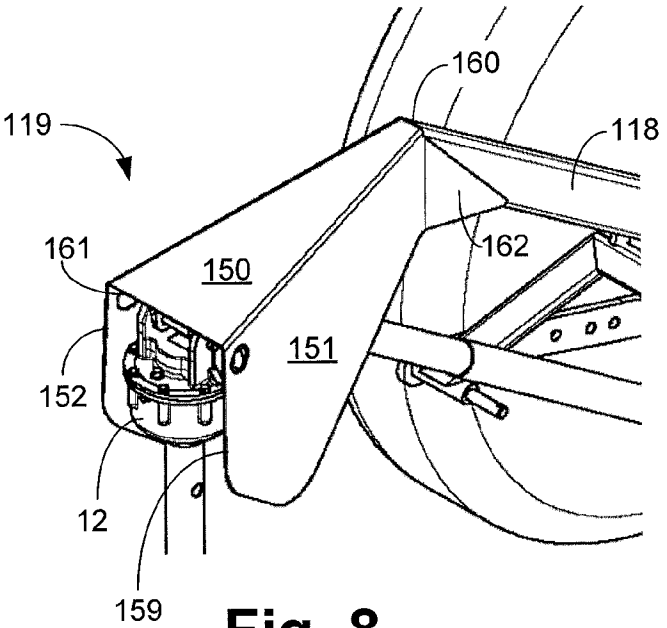
FIG. 8 is an enlarged perspective view of a shield according to an embodiment of the present disclosure.

FIG. 8 is an enlarged perspective view of the shield 119 of FIG. 7. The shield 119 is a generally thin, metal shield that is fabricated from bent steel in one embodiment. A flat top portion 150, a downwardly-extending right portion 151, and a downwardly-extending left portion 152 form the general shape of an inverted "U" when the shield 119 is viewed from the rear. The flat top portion 150 is in a generally trapezoidal shape with a narrow forward edge 160 that is rigidly affixed to the top support arm 118, by welding in the illustrated embodiment. In this regard, the top support arm 118 comprises generally hollow rectangular tubing and the forward edge 160 of the top portion 150 of the shield 119 narrows to generally the same width as the top support arm 118 and is affixed thereto. A rearward open edge 161 of the flat top portion 150 widens to a width greater than the width of the gearbox 12. Frontward side portions 162 (only one of which is shown in FIG. 8) are rigidly affixed to sides of the top support arm 118, by welding in the illustrated embodiment.

The flat top portion 150 extends transversely along the top support arm 118 such that the moving parts (e.g., the joint 35 (FIG. 10) and the shaft 42 (FIG. 10) of the digger 100 are covered on a top side of the digger 100.

Figure 9:
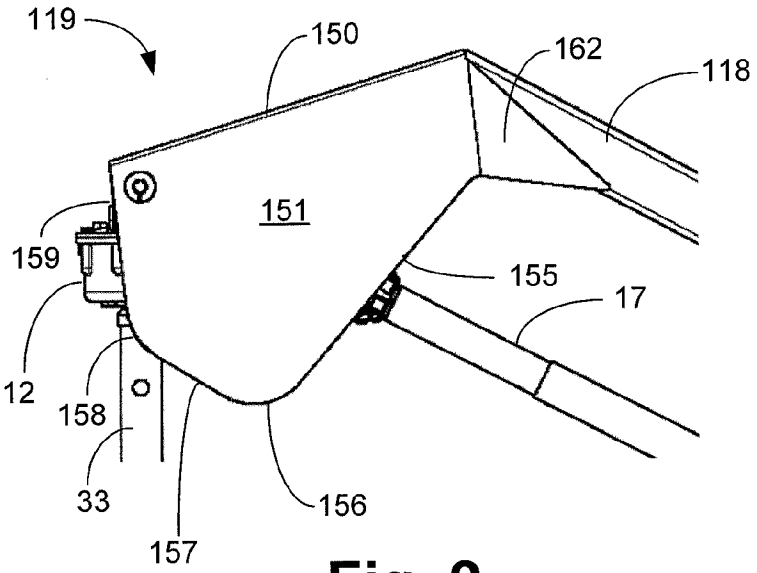
FIG. 9 is a side plan view of the shield of FIG. 8.

FIG. 9 is a side plan view of the shield 119 of FIG. 8. The right portion 151 of the shield 119 comprises a rearward edge 159 that extends downwardly from the rearward open edge 161 (FIG. 8) to a curving corner 158. The curving corner 158 transitions to an angled portion 157 that terminates at a lowermost corner 156. An angled frontward side 155 extends from the lowermost corner 156 up to the frontward side portion 162. Note that the corners 158 and 156 are rounded such that the shield 119 is generally free of sharp corners. Although not illustrated in FIG. 9, the left portion 152 (FIG. 8) of the shield is substantially similar to, and a mirror image of, the right portion 151. In the illustrated embodiment, the shield 119 does not extend to completely cover the gearbox 12. However, this is not problematic because there are generally no moving parts at the rear of the gearbox 12 and the exposed portion of the auger shaft 33 is generally free from protrusions that can ensnare the user. A key feature is that the right portion 151 (and similarly, the left portion 152 (FIG. 8)) extends sufficiently downwardly and is sufficiently wide such that the moving parts (e.g., the joint 35 (FIG. 10) and the shaft 42 (FIG. 10) are covered on opposed sides of the digger 100 while the digger 100 is in operation.

Figure 10:
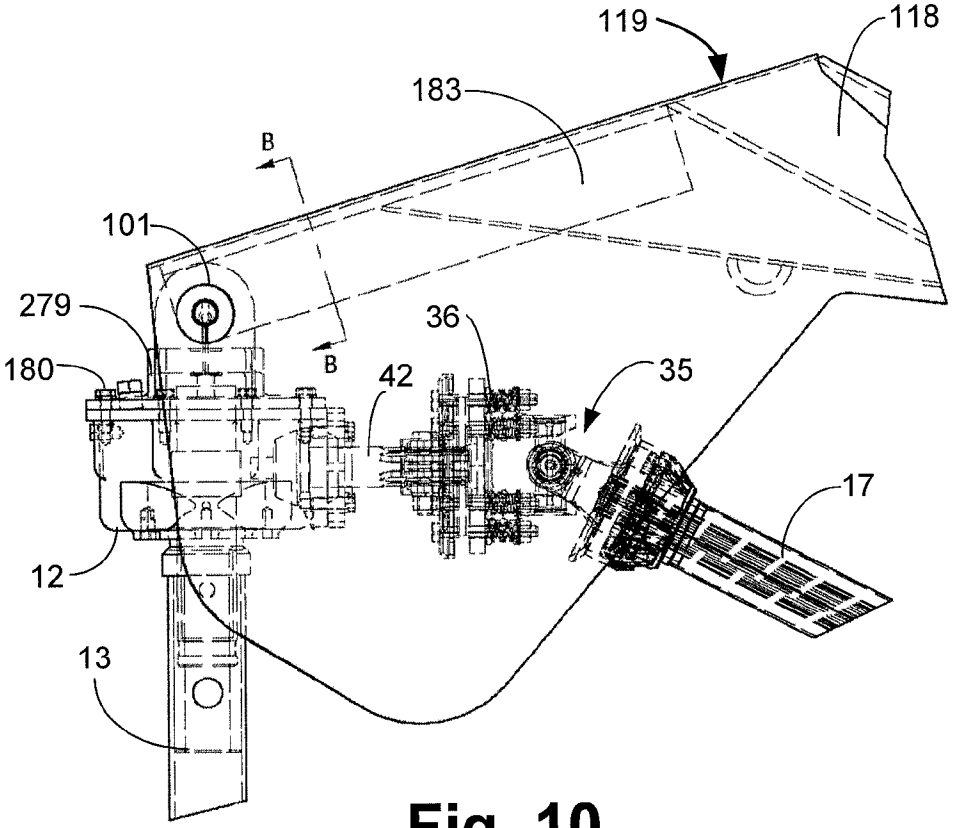
FIG. 10 is an enlarged detail view of the shield of FIG. 9, with hidden lines showing components hidden in FIG. 9.

FIG. 10 is an enlarged side plan view of the portion of the digger 10 shown in FIG. 9, including hidden lines to illustrate the components hidden by the shield 119. The cross and bearing joint 35, the clutch 36, and the gearbox shaft 42 are fully covered by the shield 119 in this embodiment to protect the user from ensnarement.

The shield 119 is rigidly affixed to angles 183 and 184 (FIG. 11), by welding in the illustrated embodiment. The angles 183 and 184 are rigidly affixed to the top support aria 118, by welding in the illustrated embodiment. Further, the angles 183 and 184 are rotatably affixed to the top gearbox cover 279, as further discussed below with respect to FIG. 11. The top gearbox cover 279 is rigidly affixed to the gearbox 12 via a plurality of fasteners 180. In this manner the shield 119 is rotatably coupled to the gearbox 12 such that the shield 119 may not be removed by the user without rendering the digger 10 (FIG. 7) inoperable.

Figure 11:
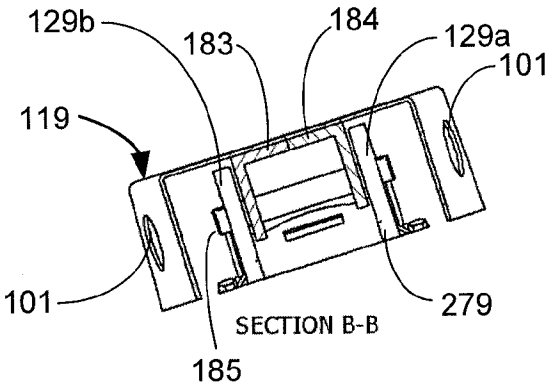
FIG. 11 is a cross-sectional view of the shield of FIG. 10, taken along section lines B-B of FIG. 10.

FIG. 11 is a cross-sectional view of the shield 119 of FIG. 10, taken along section lines B-B of FIG. 10. Angles 183 and 184 are comprised from angle iron and are welded to the shield 119 in the illustrated embodiment. The gearbox cover 279 comprises brackets 129*a* and 129*b* that are rigidly affixed to the gearbox cover 279 and comprise openings (not shown) for receiving a pin 185 that rotatably couples the angles 183 and 184 to the gearbox cover 279. In this regard, the angles 183 and 184 comprise openings (not shown) for receiving the pin 185. The pin 185 thus is received by and extends through the bracket 129*a*, the angle 184, the angle 183, and the bracket 129*b*. Openings 101 on either side of the shield 119 align with the pin 185 and are for tooling purposes.

Figure 12:
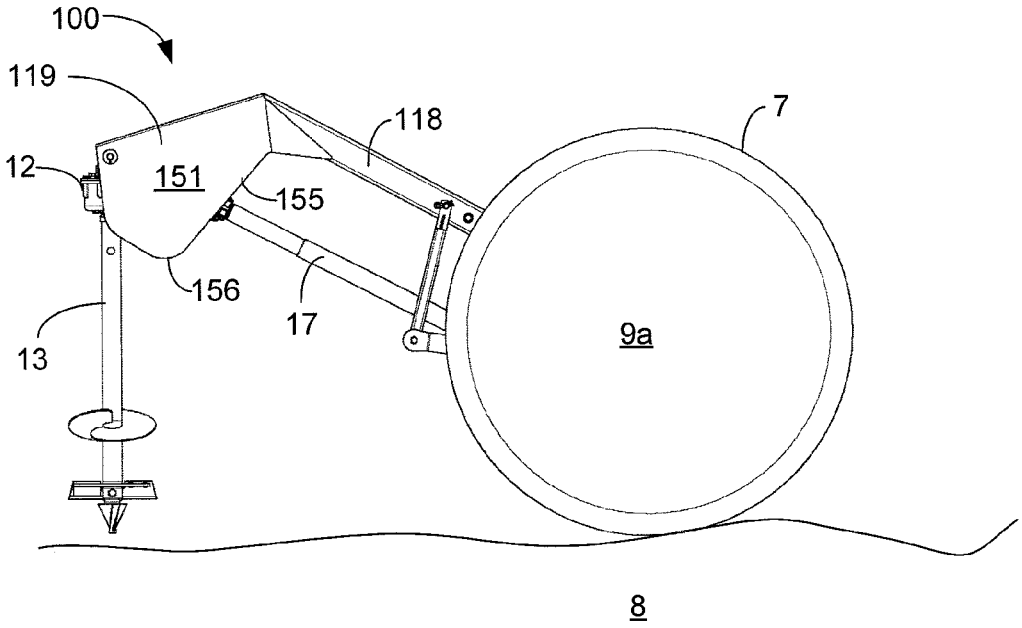
FIG. 12 is a side plan view of the digger of FIG. 7.

FIG. 12 is a side plan view of the post hole digger 100 of FIG. 7, before the auger 13 begins digging into the ground 6. Note that in this position, the top support arm 118 is generally parallel to the rotating shaft 17, in this embodiment. Further, the shield 119 fully covers the rotating parts (e.g., the joint 35 (FIG. 10), the shaft 42 (FIG. 10), and the clutch 36 (FIG. 10)) that are most likely to be injurious to the user (not shown).

Figure 13:
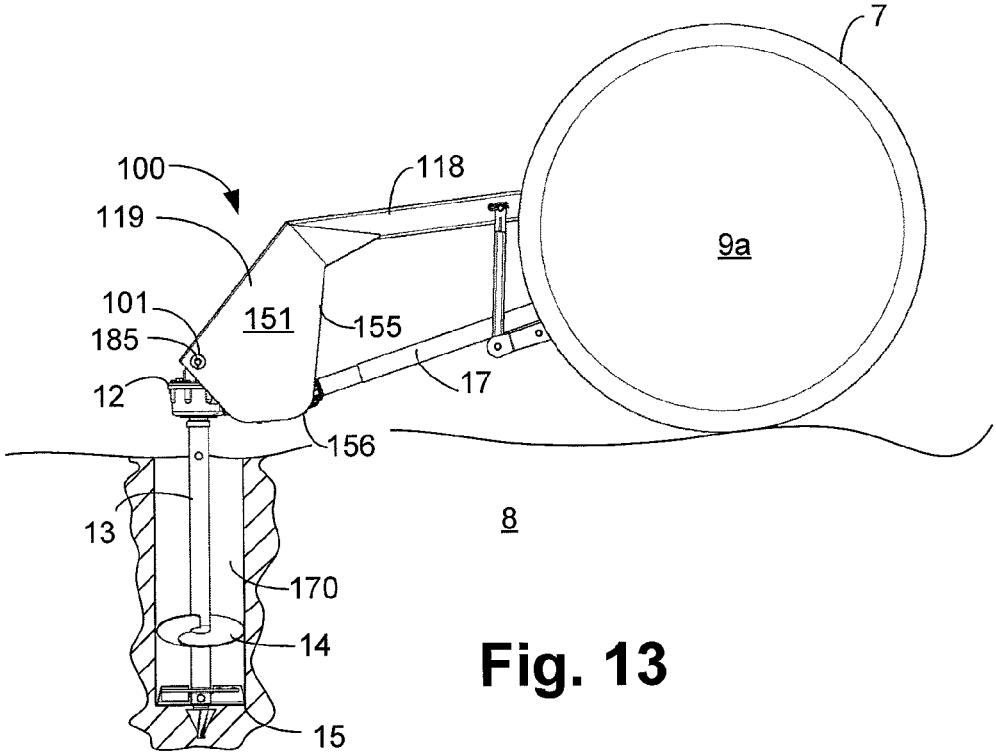
FIG. 13 is a is a side plan view of the digger of FIG. 12, after the digger has begun digging a hole.

FIG. 13 is a side plan view of the post hole digger 100 of FIG. 12 after the auger 13 has begun digging a hole 170. During hole-digging operation, the auger 13 is typically in a generally-vertical orientation (for a hole that is desired to be generally vertical). As the auger 13 digs, the support arm 118 and shield 119 rotate with respect to the gearbox 12 around pin 185. Further, the angle between the top support arm 118 and the shield 119 widens such that the joint 35 (FIG. 10) is further from the top support arm 118. The shield 119 is sized such that the downwardly-extending right portion 151, and the downwardly-extending left portion 152 (FIG. 8) extend sufficiently to keep opposed sides (not shown) of the joint 35 covered even when the auger 13 is deployed at its lowest point. This arrangement prevents the joint 35 and other potentially dangerous rotating parts forward of the gearbox 12 from being exposed to the user during use of the auger.

Figure 14:
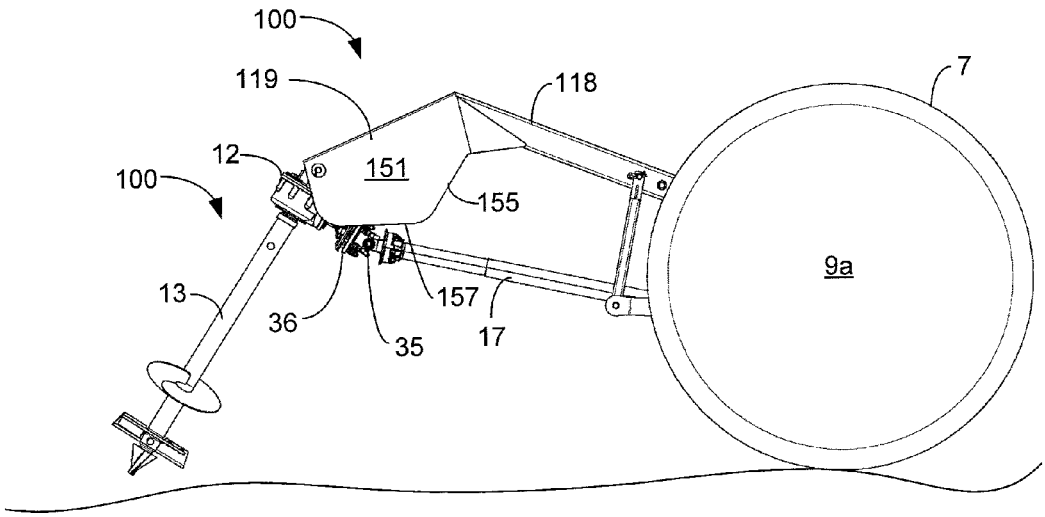
FIG. 14 is a side plan view of the digger of FIG. 12, with the auger extended rearwardly to expose the clutch and cross and bearing joint for maintenance.

FIG. 14 is a side plan view of the digger 100 of FIG. 13, with the auger 13 extended rearwardly at an angle. The auger 13 would not normally be extended in this manner during use of the digger 100, but such a position would be desired by the user during maintenance of the digger 100, for example. Extension of the auger 13 as illustrated exposes the joint 35 and the clutch 36, which are then accessible by the user for maintenance. The shield 119 is thus designed so that the most dangerous rotating parts of the digger 100 (such as the clutch 36 and joint 35) remain shielded during operation of the digger and are accessible for maintenance.

The invention claimed is:

1. A post hole digger, comprising:

a top support arm rotatably coupled to a top pin of a three point hitch of a tractor, the top support arm extending rearwardly from the tractor and rotatably supporting a gearbox;

a support frame rotatably coupled to a right and left lift arm of the three point hitch, the support frame extending upwardly and inwardly from the right and left lift arms and rotatably coupled to the support arm;

a rotating shaft rotatably coupled to a power take-off shaft of the tractor, the rotating shaft translating rotation from the power take-off shaft through a cross and bearing joint to the gearbox;

an auger coupled to the gearbox for digging holes, the auger comprising a shaft, a pair of fighting blades that do not extend continuously around the shaft and are disposed entirely near a lower end of the shaft, and a cutting head disposed at the lower end of the shaft, the shaft smooth and free from protrusions between the gearbox and flighting blades;

a shield affixed to the top support arm, the shield covering a top side, a right side, and a left side of the cross and bearing joint during operation of the auger, wherein the shield is not detachable from the digger without rendering the digger non-functional;

the gearbox comprising a top gearbox cover rigidly affixed to the gearbox on a bottom side of the top gearbox cover to enclose a top of the gearbox, the top gearbox cover rigidly affixed to the shield on a top side of the top gearbox cover.

2. The post hole digger of claim 1, the shield comprising a top portion affixed to the top support arm, the shield further comprising opposed downwardly-directed side portions, the downwardly-directed side portions covering opposed sides of the cross and bearing joint during operation of the auger.

3. The post hole digger of claim 1, wherein the support frame comprises an inverted "U" shape with an open space formed between the right and left lift arms for receiving the rotating shaft.

4. The post hole digger of claim 1, further comprising a slip clutch disposed between the gearbox and the power take-off shaft.

5. A post hole digger, comprising:

a rotating shaft coupled to a power take-off shaft of a tractor, the rotating shaft translating rotation from the power take-off shaft through a joint to a gearbox;

a top support arm rotatably coupled to a top pin of a three point hitch of the tractor, the top support arm extending rearwardly from the tractor above the rotating shaft, the top support arm rotatably supporting the gearbox;

an auger coupled to the gearbox for digging holes, the auger comprising a shaft, a pair of flighting blades that do not extend continuously around the shaft and are disposed entirely near a lower end of the shaft, and a cutting head disposed at the lower end of the shaft, the shaft smooth and free from protrusions between the gearbox and flighting blades, wherein most of the shaft is smooth and free from protrusions;

a shield affixed to the top support arm, the shield covering opposed sides of the joint during operation of the auger, wherein the shield is not detachable from the digger without rendering the digger non-functional;

the gearbox comprising a top gearbox cover rigidly affixed to the gearbox on a bottom side of the top gearbox cover to enclose a top of the gearbox, the top gearbox cover rigidly affixed to the shield on a top side of the top gearbox cover.

6. The post hole digger of claim 5, the shield comprising opposed downwardly-directed side portions, the downwardly-directed side portions covering opposed sides of the joint during operation of the auger.

7. The post hole digger of claim 5, further comprising a support frame rotatably coupled to a right and left lift arm of the three point hitch, the support frame extending upwardly from the right and left lift anus, creating a space therebetween, the space receiving the rotating shaft, the support frame rotatably coupled to the support arm, wherein the support frame comprises an inverted "U" shape.

8. The post hole digger of claim 5, wherein the shield further covers a top of the joint.

9. The post hole digger of claim 5, wherein the shield is configured such that the opposed sides of the joint are not covered by the shield when the auger is extended rearwardly at an angle for maintenance.

10. A post hole digger, comprising:

a rotating shaft coupled to a power take-off shaft of a tractor, the rotating shaft translating rotation from the power take-off shaft through a joint to a gearbox;

a top support arm rotatably coupled to a top pin of a three point hitch of the tractor, the top support arm extending rearwardly from the tractor above the rotating shaft, the top support arm rotatably supporting the gearbox;

an auger coupled to the gearbox for digging holes, the auger comprising a shaft, a pair of flighting blades that do not extend continuously around the shaft and are disposed entirely near a lower end of the shaft, and a cutting head disposed at the lower end of the shaft, the shaft smooth and free from protrusions between the gearbox and flighting blades;

a shield affixed to the gearbox, the shield covering opposed sides of the joint during operation of the auger, wherein the shield is not detachable from the digger without rendering the digger non-functional;

the gearbox comprising a top gearbox cover rigidly affixed to the gearbox on a bottom side of the top gearbox cover to enclose a top of the gearbox, the top gearbox cover rigidly affixed to the shield on a top side of the top gearbox cover.

11. The post hole digger of claim 10, the shield comprising opposed downwardly-directed side portions, the downwardly-directed side portions covering opposed sides of the joint during operation of the auger.

12. The post hole digger of claim 10, further comprising a support frame rotatably coupled to a right and left lift arm of the three point hitch, the support frame extending upwardly from the right and left lift arms, creating a space therebetween, the space receiving the rotating shaft, the support frame rotatably coupled to the support arm, wherein the support frame comprises an inverted "U" shape.

13. The post hole digger of claim 10, further comprising a slip clutch disposed between the gearbox and the power take-off shaft.

14. A post hole digger, comprising:

a top support arm rotatably coupled to a top pin of a three point hitch of a tractor, the top support arm extending rearwardly from the tractor and rotatably supporting a gearbox;

a support frame rotatably coupled to a right and left lift al iii of the three point hitch, the support frame extending upwardly and inwardly from the right and left lift arms and rotatably coupled to the support arm;

a rotating shaft rotatably coupled to a power take-off shaft of the tractor, the rotating shaft translating rotation from the power take-off shaft through a cross and bearing joint to the gearbox;

an auger coupled to the gearbox for digging holes, the auger comprising a shaft, a pair of flighting blades that do not extend continuously around the shaft and are disposed entirely near a lower end of the shaft, and a cutting head disposed at the lower end of the shaft, the shaft smooth and free from protrusions between the gearbox and fighting blades;

a shield affixed to the top support arm, the shield covering a top side, a right side, and a left side of the cross and bearing joint during operation of the auger;

a plurality of top shield brackets welded to the shield, the top shield brackets receiving a connecting pin that rotatably affixes the top support awl to the shield.

* * * * *